US006736339B1

(12) United States Patent
Mayers

(10) Patent No.: US 6,736,339 B1
(45) Date of Patent: May 18, 2004

(54) ATHLETIC SHOE CLEANING DEVICE

(76) Inventor: Val Kenneth Mayers, 31 Bayside Ct., Gulf Shores, AL (US) 36542

( * ) Notice: Subject to any disclaimer, the term of this patent is extended or adjusted under 35 U.S.C. 154(b) by 0 days.

(21) Appl. No.: 10/238,330

(22) Filed: Sep. 10, 2002

(51) Int. Cl.[7] ..... B05B 1/20; B05B 15/06; B05B 1/14; A62C 2/08; A62C 37/08

(52) U.S. Cl. ..... 239/566; 239/273; 239/279; 239/548

(58) Field of Search ..... 239/566, 273, 239/279, 548, 276, 275, 280, 285, 556

(56) References Cited

U.S. PATENT DOCUMENTS 3,697,001 A * 10/1972 Skodak ..... 239/521
3,925,830 A 12/1975 Delaney
4,784,327 A * 11/1988 Lund ..... 239/276
4,883,228 A * 11/1989 Vydrzal et al. ..... 239/279
4,918,779 A 4/1990 Burns
4,984,746 A * 1/1991 Joyal ..... 239/722
5,173,972 A 12/1992 Goodman
5,273,214 A * 12/1993 Huffstutler ..... 239/279
5,522,552 A 6/1996 Liu et al.
5,673,856 A * 10/1997 Krohn ..... 239/276
5,839,144 A 11/1998 Willner
5,950,269 A 9/1999 Openshaw et al.
6,079,640 A * 6/2000 Merritts ..... 239/532

* cited by examiner

*Primary Examiner*—Michael Mar
*Assistant Examiner*—Darren Gorman
(74) *Attorney, Agent, or Firm*—Kenneth L. Tolar

(57) ABSTRACT

A device for cleaning a shoe sole includes a substantially H-shaped base frame formed of hollow tubes having a vertical water inlet line upwardly extending therefrom. The water inlet line terminates at an upper end with a valve and hose coupling mounted thereon. The H-shaped base frame includes a transverse member having a plurality of aligned apertures oriented at a predetermined angle relative to a horizontal plane for delivering multiple pressurized streams of water at said predetermined angle to effectively clean a user's shoe sole while minimizing splashing of a user or a user's shoe.

5 Claims, 2 Drawing Sheets

ATHLETIC SHOE CLEANING DEVICE

BACKGROUND OF THE INVENTION

The present invention relates to a device for conveniently and efficiently cleaning the sole of an athletic shoe.

DESCRIPTION OF THE PRIOR ART

Many athletes typically wear certain athletic shoes when training or participating in sporting events. However, during such activity, the sole of the athletic shoe typically becomes soiled and must be cleaned prior to the wearer going indoors. For example, a tennis court often imparts a green stain on the sole of a player's shoes requiring the shoe to be cleansed with water. Additionally, other athletes such as baseball and football players will typically wear cleats, on which mud, grass and other debris accumulates. Using a conventional water hose to clean a shoe sole is not practical since it typically dampens the shoe upper and splashes water onto the user. Accordingly, there is presently a need for a device that allows an athlete to efficiently and conveniently clean his or her shoe soles.

Many foot and shoe cleaning devices have been heretofore designed. For example, U.S. Pat. No. 5,173,972 issued to Goodman discloses an automatic foot washer designed primarily for swimmers including a hollow, substantially square frame structure formed of PVC pipe bordering a grated actuator platform. The frame structure includes spray outlets configured to produce a fan spray pattern so as to contemporaneously cover a user's feet, calves and ankles. An actuator lever is connected to the platform and is in communication with a valve assembly whereby a valve is opened whenever a user steps onto the platform to automatically deliver water to the user's feet.

U.S. Pat. No. 4,918,779 issued to Burns discloses a foot spraying and cleaning device including a pair of opposed facing brushes imbedded within which is a bar having fluid outlets thereon. A foot actuated valve mechanism controls water flow through the bar. The brushes can be encapsulated in aesthetic housings.

U.S. Pat. No. 3,925,830 issued to Delaney discloses a foot shower primarily for swimmers including an actuating platform having a showerhead on each of two opposing sides. The actuating platform is operatively connected to a water source valve whereby water is automatically delivered through the showerheads whenever a user steps onto the platform.

U.S. Pat. No. 5,522,552 issued to Liu et al. discloses a water toy including a platform pivotally mounted onto a base. Valves and nozzles are mounted about the periphery of the toy between the platform and base, which are actuated upon a user stepping onto the platform.

U.S. Pat. No. 5,839,144 issued to Willner discloses a boot cleaning apparatus including brushes and scrapers.

U.S. Pat. No. 5,950,269 issued to Openshaw discloses a boot and shoe sole cleaner including brushes and scrapers.

As indicated above, numerous shoe and foot cleaning devices are disclosed in the prior art. However, most of these devices are designed to clean a swimmer's bare foot and ankle. Accordingly, each includes means for producing a wide or panoramic spray pattern, which would wet both the shoe and the wearer. The above-described devices designed for cleaning shoes include brushes and scrapers, which are designed to remove dirt and debris and are not suitable for removing certain stains or minute debris from an athletic shoe sole. In addition, many conventional cleaning devices that use water must be coupled with a domestic water source. Water is delivered to the device by opening a low profile water valve that requires an operator to kneel or stoop.

The present invention overcomes the above-described disadvantages associated with the prior art by providing a high profile shoe cleaner having a water inlet valve that is easily accessible while standing, eliminating the need to stoop to activate the device. Because the device is high profile and a water hose must be coupled with the elevated water inlet valve, the device would ordinarily be susceptible to overturning. Accordingly, the device includes a wide, hollow base frame that fills with water when in use to sufficiently ballast the device in an upright position. Furthermore, uniquely oriented perforations are disposed on the base frame for projecting multiple water streams at a predetermined angle so as to minimize splashing of the user and to assure that water contact is restricted to the shoe sole.

SUMMARY OF THE INVENTION

The present invention relates to an athletic shoe cleaning device. The device includes a substantially H-shaped base frame including a pair of parallel tubular arms with a transverse tubular member perpendicularly disposed therebetween. Vertically extending from the transverse member is a water inlet line terminating at an upper end. A valve and hose coupling are mounted on the upper end of the inlet line to which a conventional water source is connected. Along a portion of the transverse member are a plurality of aligned perforations selectively positioned to project streams of pressurized water at a predetermined angle relative to a horizontal plane allowing a user to clean his or her shoe sole without getting wet.

It is therefore an object of the present invention to provide a shoe cleaning device that is easy to operate.

It is another object of the present invention to provide a shoe cleaning device that projects pressurized water streams toward a user's shoe sole while protecting the user from splashing.

It is yet another object of the present invention to provide a shoe cleaning device having a water delivery valve that is conveniently accessible without stooping. Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
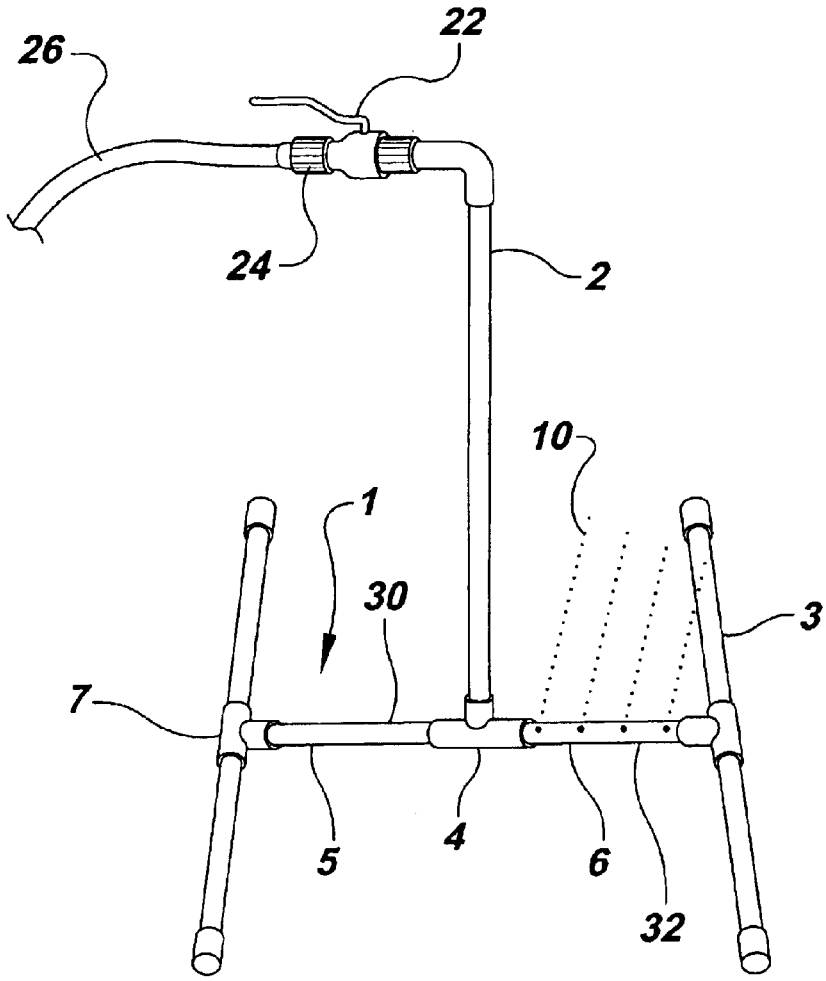
FIG. 1 is a perspective view of the device.
Figure 2:
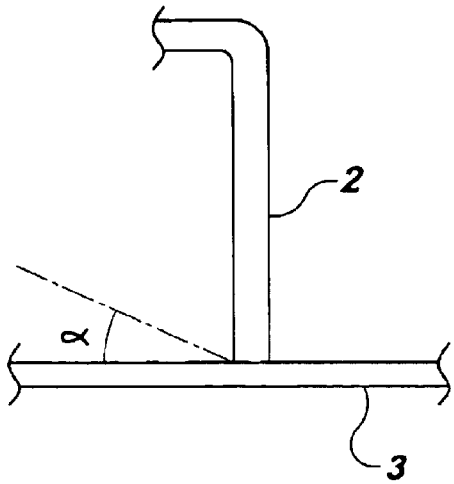
FIG. 2 is a side view of the device depicting an exemplary spray angle.
Figure 3:
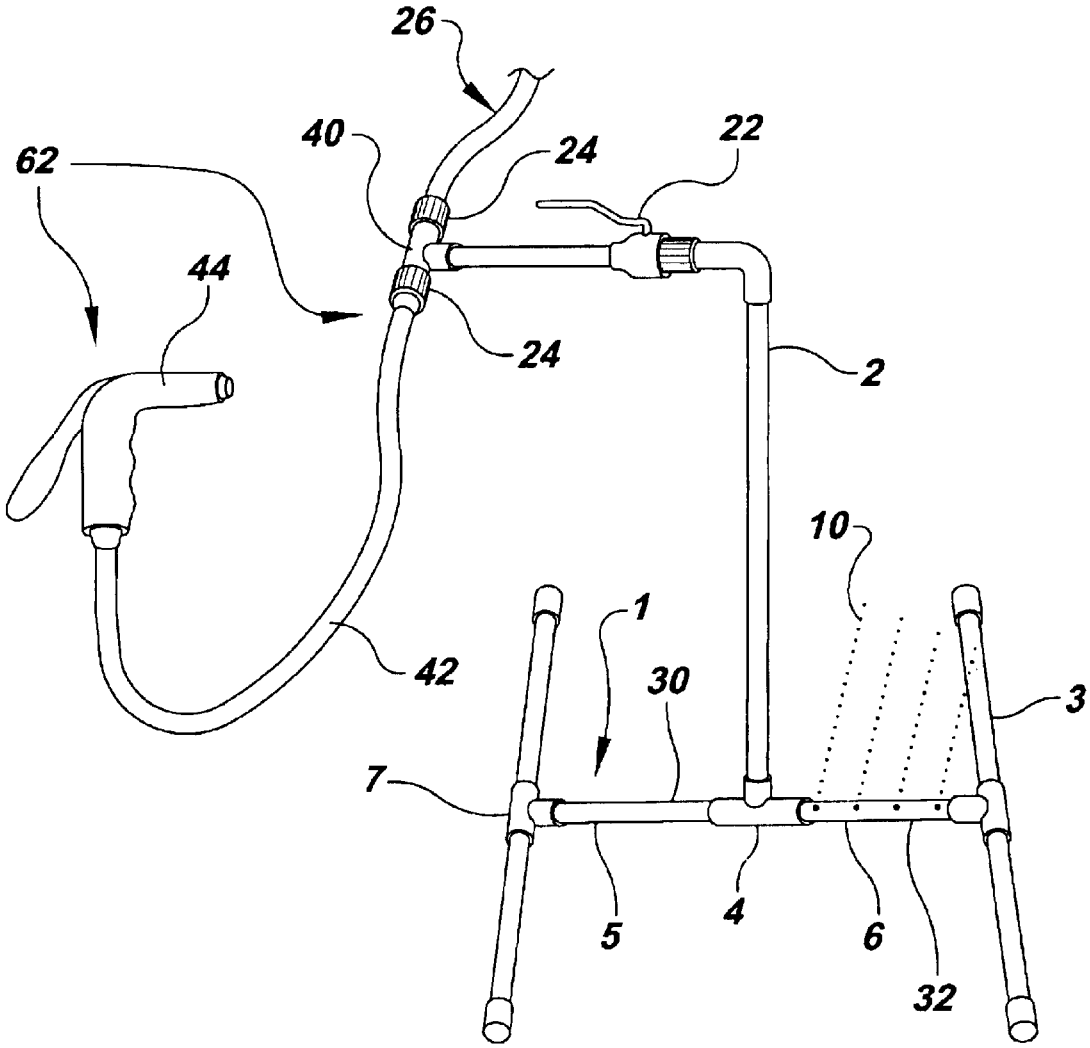
FIG. 3 is a perspective view of the device with an auxiliary spray attachment secured thereto.

Now referring to FIGS. 1 through 3, the present invention relates to an athletic shoe cleaning device. The device comprises a substantially H-shaped base frame I formed of a pair of parallel, spaced tubular arms 3 with a transverse tubular member 5 perpendicularly disposed therebetween. In the preferred embodiment, the arms and transverse member are pipes joined with tee fittings 7, or any other type of hollow structure capable of functioning as a fluid conduit.

Vertically extending from the transverse member is an elongated, high profile water inlet line 2 terminating at an upper end. The inlet line is preferably joined with the transverse member using a tee fitting 4 or similar device though any other conventional means is used. Attached to the upper end of the inlet line is a water delivery valve 22 and hose coupling 24. A conventional garden variety water supply hose 26 may be joined with the hose coupling to provide a water source for the device.

The length of the inlet line is such that the valve and hose coupling are preferably positioned at a height proximal a user's upper torso allowing the user to easily activate or deactivate the water delivery valve without stooping. Furthermore, the inlet line is in fluid communication with each of the base frame components so that when water is delivered to the device, the frame fills with water effectively ballasting the high profile device in an upright position.

The tee fitting 4 and adjoining water inlet line are preferably coupled with the transverse member at a select distance from its median so as to segregate the transverse member into a shorter section 30 and a longer section 32. Mounting the water inlet line a select distance from the transverse member median provides greater balance and stability to the device. Positioned on the longer section are a plurality of aligned apertures 6 or perforations, each for delivering a pressurized stream 10 of water to the atmosphere.

The perforations are selectively oriented so that each water stream is projected at a predetermined angle a relative to a horizontal plane allowing a user to clean a shoe sole without dampening other areas of the shoe. In the preferred embodiment, angle $\alpha$ is between 0° and 90°, though the angle can be varied. Furthermore, the angular projection of the cleaning fluid minimizes splashing of the user. Positioning the perforations on the longer section provides an enlarged spray area for accommodating a user's shoe.

The device also may include a spray attachment 62. In such event, a tee fitting 40 is coupled with the water inlet to which a hose fitting is attached at both of two inlets. The water supply hose 26 is secured to the hose fitting on one of the inlets. The spray attachment includes a hose 42 attached to the hose fitting on the other inlet. The hose 42 includes a spray nozzle 44 at an end thereof. The spray attachment could be used to clean a user's hands, equipment or any other similar items.

The present invention is not to be limited to the exact details of construction and enumeration of parts set forth above. For example, although the device has been designed primarily for cleaning the sole of a tennis or athletic shoe, the device can also be used to clean any other type of conventional shoe. Though the tubular base frame and water inlet line are preferably constructed with stainless steel, other materials such as PVC may be used. Furthermore, the size, shape and materials and construction of the various components may be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An athletic shoe cleaning device comprising:

a base frame, said base frame being substantially H-shaped and formed of a pair of opposing parallel hollow tubular arms with a transverse tubular member perpendicularly disposed therebetween, a vertical water inlet line upwardly extending from said base frame, said water inlet line attached at a select distance from a median of said transverse member dividing said transverse member into a shorter section and a longer section, said inlet line terminating at an upper end, said upper end having a water flow control valve mounted thereon, said water inlet line having sufficient length so as to elevate said valve to a select height corresponding to that of a user's upper torso; said transverse member and said arms all in fluid communication with each other whereby said base frame fills with water when a water stream is delivered to said water inlet line thereby ballasting the device in an upright position;

means for connecting a water source to said inlet line;

a plurality of perforations disposed on said base frame, said perforations oriented so as to project multiple pressurized streams of water at a predetermined angle relative to a horizontal plane so as to effectively clean a user's shoe sole while minimizing splashing of a user.

2. The device according to claim 1 wherein said perforations are disposed on said longer section providing an enlarged area dimensioned to accommodate a user's foot.

3. The device according to claim 2 wherein said predetermined angle is greater than zero degrees and less than ninety degrees so as to minimize splashing of the user.

4. The device according to claim 3 further comprising an auxiliary spray attachment mounted on the upper end of said water inlet line for cleaning accessory items.

5. The device according to claim 4 wherein said means for connecting a water source to said inlet line comprises a hose coupling attached to the upper end of said water inlet line.

* * * * *